US007493953B2

(12) United States Patent
Ayasse

(10) Patent No.: US 7,493,953 B2
(45) Date of Patent: Feb. 24, 2009

(54) OILFIELD ENHANCED IN SITU COMBUSTION PROCESS

(75) Inventor: Conrad Ayasse, Calgary (CA)

(73) Assignee: Archon Technologies Lcd., Calgary, Alberta (CA)

( * ) Notice: Subject to any disclaimer, the term of this patent is extended or adjusted under 35 U.S.C. 154(b) by 0 days.

(21) Appl. No.: 12/076,024

(22) Filed: Mar. 13, 2008

(65) Prior Publication Data

US 2008/0169096 A1 Jul. 17, 2008

Related U.S. Application Data

(60) Division of application No. 11/364,112, filed on Feb. 27, 2006, which is a continuation-in-part of application No. PCT/CA2005/000883, filed on Jun. 6, 2005.

(60) Provisional application No. 60/577,779, filed on Jun. 7, 2004.

(51) Int. Cl.
*E21B 43/24* (2006.01)
*E21B 43/243* (2006.01)

(52) U.S. Cl. ..... 166/261; 166/269; 166/272.1; 166/272.3; 166/272.6; 166/272.7

(58) Field of Classification Search ..... 166/261, 166/269

See application file for complete search history.

(56) References Cited

U.S. PATENT DOCUMENTS

| | | | | | |
|---|---|---|---|---|---|
| 3,448,807 | A * | 6/1969 | Strickland, Jr. | ..... | 166/256 |
| 3,502,372 | A * | 3/1970 | Prats | ..... | 299/5 |
| 3,542,129 | A * | 11/1970 | Bauer | ..... | 166/261 |
| 3,565,174 | A * | 2/1971 | Parker et al. | ..... | 166/261 |
| 3,727,686 | A * | 4/1973 | Prates et al. | ..... | 166/261 |
| 4,031,956 | A * | 6/1977 | Terry | ..... | 166/261 |
| 4,274,487 | A * | 6/1981 | Hollingsworth et al. | ..... | 166/261 |
| 4,460,044 | A * | 7/1984 | Porter | ..... | 166/252.1 |
| 4,557,329 | A * | 12/1985 | Savard et al. | ..... | 166/261 |
| 4,669,542 | A * | 6/1987 | Venkatesan | ..... | 356/243.2 |
| 5,339,897 | A * | 8/1994 | Leaute | ..... | 166/245 |
| 5,456,315 | A * | 10/1995 | Kisman et al. | ..... | 166/245 |
| 2001/0049342 | A1 * | 12/2001 | Passey et al. | ..... | 507/200 |
| 2008/0066907 | A1 * | 3/2008 | Ayasse | ..... | 166/260 |

* cited by examiner

*Primary Examiner*—George Suchfield
(74) *Attorney, Agent, or Firm*—Gowling Lafleur Henderson LLP; D. Doak Horne

(57) ABSTRACT

A process for improved safety and productivity when undertaking oil recovery from an underground reservoir by the toe-to-heel in situ combustion process employing a horizontal production well. Water, steam, and/or a non-oxidizing gas, which in the preferred embodiment substantially comprises carbon dioxide which acts as a gaseous solvent, is injected into the reservoir for improving recovery in an in situ combustion recovery process, via either an injection well, a horizontal well, or both.

6 Claims, 3 Drawing Sheets

Reservoir Dimensions and Placement of Wells

Figure 1. THAI™ in situ Combustion Process
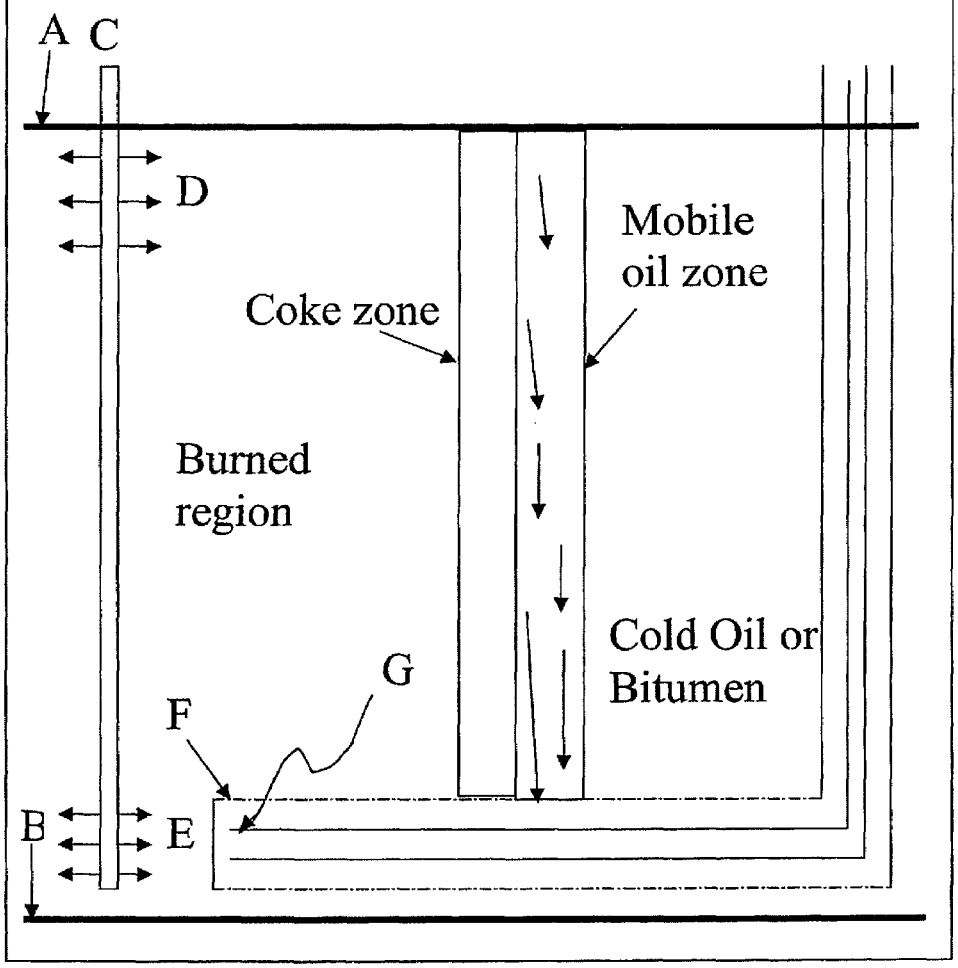

Figure 2. Reservoir Dimensions and Placement of Wells
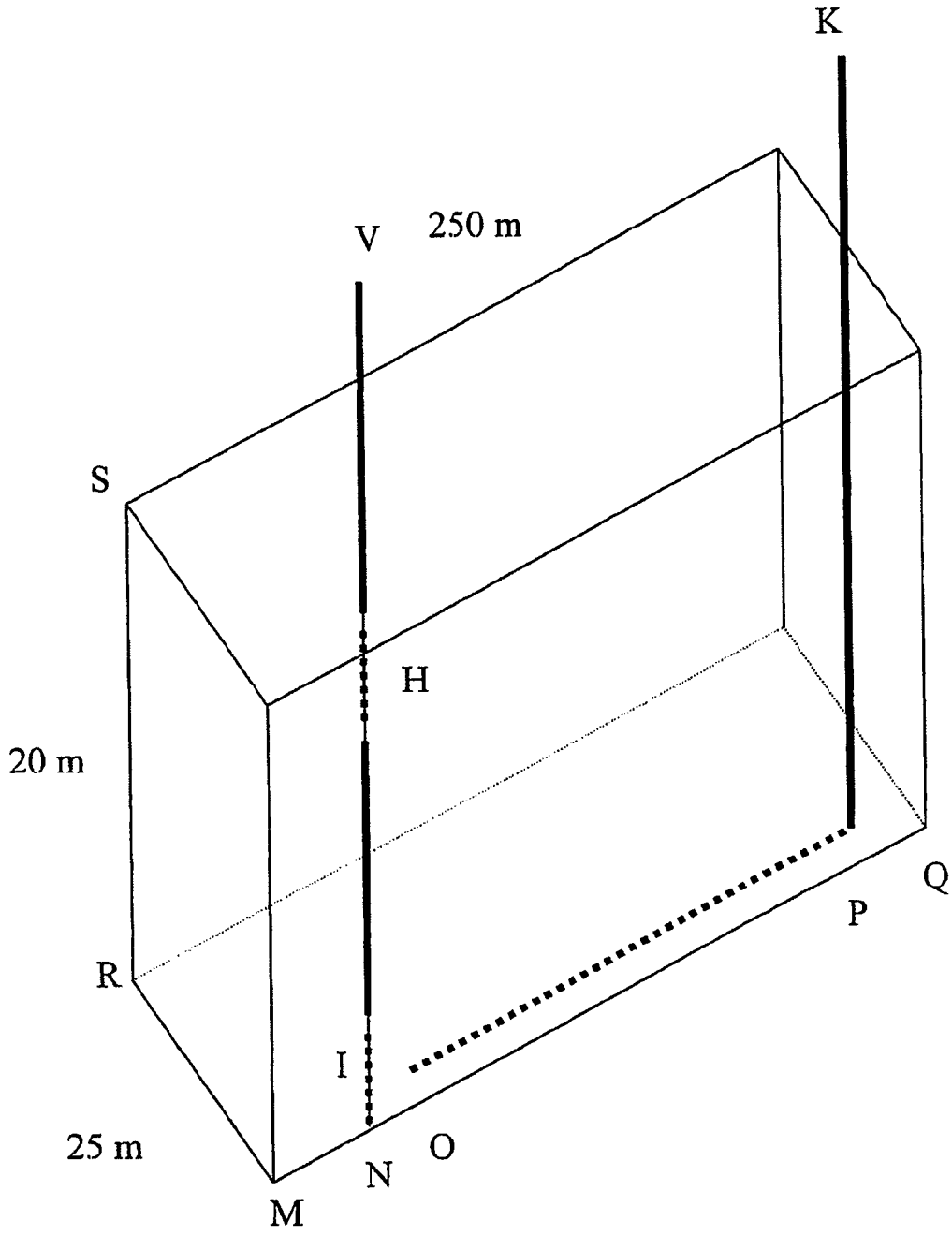

Figure 3. Graph Plotting Production Rate versus CO2 Rate in Produced Gas
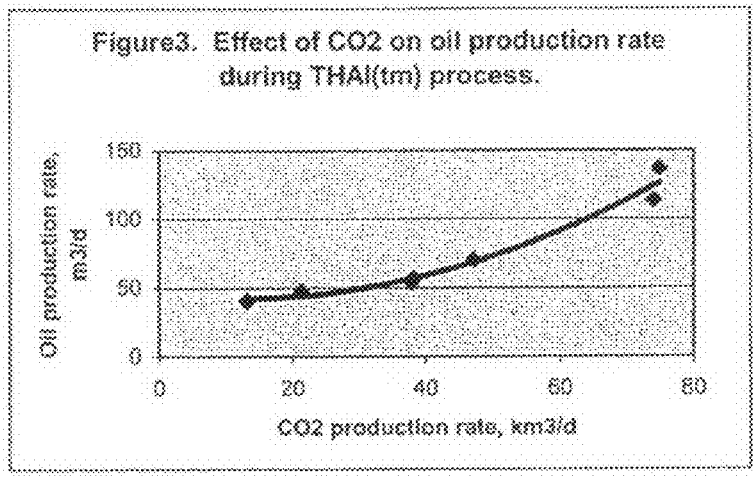

OILFIELD ENHANCED IN SITU COMBUSTION PROCESS

RELATED APPLICATIONS

This application is a divisional of U.S. patent application Ser. No. 11/364,112 filed Feb. 27, 2006 which is a continuation-in-part of PCT application PCT/CA2005/000883 filed on Jun. 6, 2005 in which the United States was designated, claiming priority from U.S. Provisional Application 60/577,779 filed Jun. 7, 2004, each of which are incorporated herein by reference in their entirety and for all their teachings, disclosures and purposes.

FIELD OF THE INVENTION

This invention relates to a process for improved safety and productivity when undertaking oil recovery from an underground reservoir by the toe-to-heel in situ combustion process employing horizontal production wells, such as disclosed in U.S. Pat. Nos. 5,626,191 and 6,412,557. More particularly, it relates to an in situ combustion process in which a water, steam, and/or a non-oxidizing gas which in a preferred embodiment is carbon dioxide which acts as a gaseous solvent, is injected into the reservoir for improving recovery in an in situ combustion recovery process.

BACKGROUND OF THE INVENTION

U.S. Pat. Nos. 5,626,191 and 6,412,557, incorporated herein in their entirety, disclose in situ combustion processes for producing oil from an underground reservoir (100) utilizing an injection well (102) placed relatively high in an oil reservoir (100) and a production well (103-106) completed relatively low in the reservoir (100). The production well has a horizontal leg (107) oriented generally perpendicularly to a generally linear and laterally extending upright combustion front propagated from the injection well (102). The leg (107) is positioned in the path of the advancing combustion front. Air, or other oxidizing gas, such as oxygen-enriched air, is injected through wells 102, which may be vertical wells, horizontal wells or combinations of such wells. The process of U.S. Pat. No. 5,626,191 is called "THAI™", an acronym for "toe-to-heel air injection" and the process of U.S. Pat. No. 6,412,557 is called "Capri™", the Trademarks being held by Archon Technologies Ltd., a subsidiary of Petrobank Energy and Resources Ltd., Calgary, Alberta, Canada.

High-Pressure-Air-Injection, HPAI, is an in situ combustion process that is applied in tight reservoirs containing light oil. In these reservoirs, a liquid such as water cannot be effectively injected because of low reservoir permeability. Air is injected in the upper reaches of the reservoir and oil drains into a horizontal well placed low in the reservoir. The process provides some heat by low-temperature oil oxidation and more importantly, it provides pressure-maintenance to enable high sustained oil rates. This process can be applied in any reservoir that contains oil that is mobile at reservoir conditions.

Of concern is the safety of the THAI™ and Capri™ processes with respect to oxygen entry into the horizontal well, which would cause oil burning in the well and extremely high temperatures that would destroy the well. Such oxygen breakthrough will not occur if the injection rates are kept low, however, high injection rates are very desirable in order to maintain high oil production rates and a high oxygen flux at the combustion front. A high oxygen flux is known to keep the combustion in the high-temperature oxidation (HTO) mode, achieving temperatures of greater than 350° C. and combusting the fuel substantially to carbon dioxide. At low oxygen flux, low-temperature oxidation (LTO) occurs and temperatures do not exceed ca. 350° C. In the LTO mode, oxygen becomes incorporated into the organic molecules, forming polar compounds that stabilize detrimental water-oil emulsions and accelerate corrosion because of the formation of carboxylic acids. In conclusion, the use of relatively low oxidant injection rates is not an acceptable method to prevent combustion in the horizontal wellbore.

What is needed is one or more methods to increase the oxidizing gas injection rate while preventing oxygen entry into the horizontal wellbore The present invention provides such methods.

SUMMARY OF THE INVENTION

The THAI™ and Capri™ processes depend upon two forces to move oil, water and combustion gases into the horizontal wellbore for conveyance to the surface. These are gravity drainage and pressure The liquids, mainly oil, drain into the wellbore under the force of gravity since the wellbore is placed in the lower region of the reservoir. Both the liquids and gases flow downward into the horizontal wellbore under the pressure gradient that is established between the reservoir and the wellbore.

During the reservoir pre-heating phase, or start-up procedure, steam is circulated in the horizontal well through a tube that extends to the toe of the well. The steam flows back to the surface through the annular space of the casing. This procedure is imperative in bitumen reservoirs because cold oil that may enter the well will be very viscous and will flow poorly, possible plugging the wellbore. Steam is also circulated through the injector well and is also injected into the reservoir in the region between the injector wells and the toe of the horizontal wells to warm the oil and increase its mobility prior to initiating injection of oxidizing gas into the reservoir.

The aforementioned patents show that with continuous oxidizing gas injection a quasi-vertical combustion front develops and moves laterally from the direction of the toe of the horizontal well towards the heel. Thus two regions of the reservoir are developed relative to the position of the combustion zone. Towards the direction of toe, lies the oil-depleted region that is filled substantially with oxidizing gas, and on the other side lies the region of the reservoir containing cold oil or bitumen. At higher oxidant injection rates, reservoir pressure increases and the fuel deposition rate can be exceeded, so that gas containing residual oxygen can be forced into the horizontal wellbore in the oil-depleted region.

The consequence of having oil and oxygen together in a wellbore is combustion and potentially an explosion with the attainment of high temperatures, perhaps in excess of 1000° C. This can cause irreparable damage to the wellbore, including the failure of the sand retention screens. The presence of oxygen and wellbore temperatures over 425° C. must be avoided for safe and continuous oil production operations.

Several methods of preventing oxygen entry into the producing wellbore are based on reducing the differential pressure between the reservoir and the horizontal wellbore. These are 1. to reduce the injection rate of the oxidizing gas in order to reduce the reservoir pressure, and 2. to reduce the fluid drawdown rate to increase wellbore pressure. Both of these methods result in the reduction of oil rates, which is economically detrimental. Conventional thinking would also state that injecting fluid directly into the wellbore would increase wellbore pressure but would be very detrimental to production rates.

Importantly, it has been discovered that in an in situ combustion process generally, if carbon dioxide is injected into the reservoir along with the oxidizing gas, the oil recovery rate is increased This is true whether the ISC process is of the traditional, THAI™, Capri™, HPAI or any other type.

Specifically, when the injected non-oxidizing gas which is injected with oxygen comprises only carbon dioxide in the absence of nitrogen, the improvement can be dramatic.

Thus in a preferred embodiment of the invention, the injected non-oxidizing gas is carbon dioxide.

Advantageously, in an in situ combustion recovery process, when O2 is injected alone, the recovered combustion gas, which substantially comprises CO2, can be compressed and mixed with the oxygen Any ratio of O2 to CO2 can be attained by adjusting the percentage of recycled produced CO2.

If the produced combustion gas contains impurities, these will not build-up if an appropriate slip stream of combustion gas is disposed.

Since the disposed gas will be typically about 95% CO2 it can be sold without purification for enhanced oil recovery by miscible flooding, or can be disposed into a deep aquifer.

It is not required that the CO2 be miscible (ie. soluble in all proportions) in the oil under reservoir conditions. Partial solubility is adequate.

While the mechanics of how adding a particular non-oxidizing gas such as CO2, as opposed to other non-oxidizing gases, further increases the mobility of hydrocarbons in a reservoir are not precisely understood, and without being in any way held to an explanation as to why such important increases in recoverability are obtained as a result of CO2 injection, it is suspected that CO2 acts as a solvent and decreases the oil viscosity ahead of the combustion zone, thereby enhancing the combustion process and thus further liquefying oil ahead of the combustion zone. The added dissolution of some CO2 in the combustion front also facilitates the transfer of heat from the combustion gas into the oil, which also reduces the oil viscosity, thus increasing recovery.

Thus in order to overcome the disadvantages of the prior art, and to improve the safety or productivity of hydrocarbon recovery from an underground reservoir, the present invention accordingly in a first broad embodiment comprises a process for extracting liquid hydrocarbons from an underground reservoir comprising the steps of:

(a) providing at least one injection well for injecting an oxidizing gas into the underground reservoir;

(b) providing at least one production well having a substantially horizontal leg and a substantially vertical production well connected thereto, wherein the substantially horizontal leg extends toward the injection well, the horizontal leg having a heel portion in the vicinity of its connection to the vertical production well and a toe portion at the opposite end of the horizontal leg, wherein the toe portion is closer to the injection well than the heel portion;

(c) injecting an oxidizing gas through the injection well to conduct in situ combustion, so that combustion gases are produced so as to cause the combustion gases to progressively advance as a front, substantially perpendicular to the horizontal leg, in the direction from the toe portion to the heel portion of the horizontal leg, and fluids drain into the horizontal leg;

(d) providing a tubing inside the production well within said vertical leg and at least a portion of said horizontal leg for the purpose of injecting steam, water or non-oxidizing gas into said horizontal leg portion of said production well proximate a combustion front formed at a horizontal distance along said horizontal leg of said production well;

(e) injecting a medium selected from the group of mediums comprising steam, water, or non-oxidizing gas, into said tubing so that said medium is conveyed proximate said toe portion of said horizontal leg portion via said tubing; and (f) recovering hydrocarbons in the horizontal leg of the production well from said production well.

In a preferred embodiment, the tubing in step (d) may be pulled back or otherwise repositioned for the purpose of altering a point of injection of the steam, water, or non-oxidizing gas along the horizontal leg.

In a further broad embodiment of the invention, the present invention comprises a process for extracting liquid hydrocarbons from an underground reservoir, comprising the steps of:

(a) providing at least one injection well for injecting an oxidizing gas into an upper part of an underground reservoir;

(b) providing at least one injection well, either the aforementioned injection well in (a) or another well, for injecting steam, a non-oxidizing gas, or water which is subsequently heated to steam, into a lower part of an underground reservoir;

(c) providing at least one production well having a substantially horizontal leg and a substantially vertical production well connected thereto, wherein the substantially horizontal leg extends toward the injection well, the horizontal leg having a heel portion in the vicinity of its connection to the vertical production well and a toe portion at the opposite end of the horizontal leg, wherein the toe portion is closer to the injection well than the heel portion;

(d) injecting an oxidizing gas through the injection well for in situ combustion, so that combustion gases are produced, wherein the combustion gases progressively advance as a front, substantially perpendicular to the horizontal leg, in the direction from the toe portion to the heel portion of the horizontal leg, and fluids drain into the horizontal leg;

(e) injecting a medium, wherein said medium is selected from the group of mediums comprising steam, water or a non-oxidizing gas, into said injection well; and (f) recovering hydrocarbons in the horizontal leg of the production well from said production well.

In a still further embodiment of the invention, the present comprises the combination of the above steps of injecting a medium to the formation via the injection well, and as well injecting a medium via tubing in the horizontal leg. Accordingly, in this further embodiment the present invention comprises a method for extracting liquid hydrocarbons from an underground reservoir, comprising the steps of:

a) providing at least one injection well for injecting an oxidizing gas into an upper part of an underground reservoir;

b) providing at least one injection well, either the aforementioned well in (a) or another injection well, for injecting steam, a non-oxidizing gas, or water which is subsequently heated to steam, into a lower part of an underground reservoir;

c) providing at least one production well having a substantially horizontal leg and a substantially vertical production well connected thereto, wherein the substantially horizontal leg extends toward the injection well, the horizontal leg having a heel portion in the vicinity of its connection to the vertical production well and a toe portion at the opposite end of the horizontal leg, wherein the toe portion is closer to the injection well than the heel portion;

d) providing a tubing inside the production well for the purpose of injecting steam, water or non-oxidizing gas into said horizontal leg portion of said production well;

e) injecting an oxidizing gas through the injection well for in situ combustion, so that combustion gases are produced, wherein the combustion gases progressively advance as a front, substantially perpendicular to the horizontal leg, in the direction from the toe portion to the heel portion of the horizontal leg, and fluids drain into the horizontal leg;

f) injecting a medium, wherein said medium is selected from the group of mediums comprising steam, water or a non-oxidizing gas, into said injection well and into said tubing; and (g) recovering hydrocarbons in the horizontal leg of the production well from said production well.

If the medium is steam, it is injected into the reservoir/formation, via either or both the injection well or the production well via tubing therein, in this state, typically under a pressure of 7000 KpA.

Alternatively, where the injected medium is water, such method contemplates that the water become heated at the time of supply to the reservoir to become steam. The water, when it reaches the formation, via either or both the injection well and/or the tubing in the production well, may be heated to steam during such travel, or immediately upon its exiting of the injection well and/or tubing in the production well and its entry into the formation.

Lastly, in a further broad aspect of the present invention for use in an in-situ combustion hydrocarbon recovery process from subterranean deposits, the method of the present invention comprises the steps of:

(a) providing at least one injection well for injecting an oxidizing gas into an upper part of an underground reservoir;

(b) said at least one injection well further adapted for injecting carbon dioxide into a lower part of an underground reservoir;

(c) providing at least one production well;

(d) injecting an oxidizing gas through the injection well for in situ combustion, so that combustion gases are produced;

(e) injecting carbon dioxide alone or in combination with oxygen into said injection well; and (f) recovering hydrocarbons from said production well.

In another variation of the above, the method of the present invention comprises a process for extracting liquid hydrocarbons from an underground reservoir, comprising the steps of:

(a) providing at least one oxidizing gas injection well for injecting an oxidizing gas into an upper part of an underground reservoir;

(b) providing at least one other injection well for injecting carbon dioxide into a lower part of an underground reservoir;

(c) providing at least one production well;

(d) injecting an oxidizing gas through the oxidizing injection well for in situ combustion, so that combustion gases are produced;

(e) injecting carbon dioxide alone or in combination with oxygen into said other injection well; and (f) recovering hydrocarbons from said production well.

It is to be noted that, where CO2 is injected into the injection well, one or more additional non-oxidizing gasses could also be injected at the same time in combination with the CO2

BRIEF DESCRIPTION OF THE DRAWINGS

FIG. 1 is a schematic of the THAI™ in situ combustion process with labeling as follows:

Item A represents the top level of a heavy oil or bitumen reservoir, and B represents the bottom level of such reservoir/formation.

C represents a vertical well with D showing the general injection point of a oxidizing gas such as air.

E represents a general location for the injection of steam or a non-oxidizing gas into the reservoir. This is part of the present invention.

F represents a partially perforated horizontal well casing. Fluids enter the casing and are typically conveyed directly to the surface by natural gas lift through another tubing located at the heel of the horizontal well (not shown).

G represents a tubing placed inside the horizontal leg. The open end of the tubing may be located near the end of the casing, as represented, or elsewhere. The tubing can be 'coiled tubing' that may be easily relocated inside the casing. This is part of the present invention.

The elements E and G are part of the present invention and steam or non-oxidizing gas may be injected at E and/or at G. E may be part of a separate well or may be part of the same well used to inject the oxidizing gas. These injection wells may be vertical, slanted or horizontal wells or otherwise and each may serve several horizontal wells.

For example, using an array of parallel horizontal leg as described in U.S. Pat. Nos. 5,626,191 and 6,412,557, the steam, water or non-oxidizing gas may be injected at any position between the horizontal legs in the vicinity of the toe of the horizontal legs.

FIG. 2 is a schematic diagram of the Model reservoir. The schematic is not to scale. Only an 'element of symmetry' is shown. The full spacing between horizontal legs is 50 meters but only the half-reservoir needs to be defined in the STARS™ computer software. This saves computing time. The overall dimensions of the Element of Symmetry are:

length M-Q is 250 m; width M-R is 25 m; height R-S is 20 m.

The positions of the wells are as follows:

Oxidizing gas injection well J is placed at N in the first grid block 50 meters (M-N) from a corner M. The toe of the horizontal well K is in the first grid block between M and R and is 15 m (N-O) offset along the reservoir length from the injector well V. The heel of the horizontal well K lies at P and is 50 m from the corner of the reservoir, Q. The horizontal section of the horizontal well K is 135 m (Q-P) in length and is placed 2.5 m above the base of the reservoir (M-Q) in the third grid block.

The Injector well V is perforated in two (2) locations. The perforations at Z are injection points for oxidizing gas, while the perforations at Y are injection points for steam or non-oxidizing gas. The horizontal leg (Q-P) is perforated 50% and contains tubing open near the toe (not shown, see FIG. 1).

FIG. 3 is a graph plotting oil production rate vs. CO2 rate in the produced gas, drawing on Example 7 discussed below.

DESCRIPTION OF THE PREFERRED EMBODIMENT

The operation of the THAI™ process has been described in U.S. Pat. Nos. 5,626,191 and 6,412,557 and will be briefly reviewed. The oxidizing gas, typically air, oxygen or oxygen-enriched air, is injected into the upper part of the reservoir. Coke that was previously laid down consumes the oxygen so that only oxygen-free gases contact the oil ahead of the coke zone. Combustion gas temperatures of typically 600° C. and as high as 1000° C. are achieved from the high-temperature oxidation of the coke fuel. In the Mobile Oil Zone (MOZ), these hot gases and steam heat the oil to over 400° C., partially cracking the oil, vaporizing some components and greatly reducing the oil viscosity. The heaviest components of the oil, such as asphaltenes, remain on the rock and will constitute the coke fuel later when the burning front arrives at that location. In the MOZ, gases and oil drain downward into the horizontal well, drawn by gravity and by the low-pressure sink of the well. The coke and MOZ zones move laterally from the direction from the toe towards the heel of the horizontal well. The section behind the combustion front is labeled the Burned Region. Ahead of the MOZ is cold oil.

With the advancement of the combustion front, the Burned Zone of the reservoir is depleted of liquids (oil and water) and is filled with oxidizing gas. The section of the horizontal well opposite this Burned Zone is in jeopardy of receiving oxygen which will combust the oil present inside the well and create extremely high wellbore temperatures that would damage the steel casing and especially the sand screens that are used to permit the entry of fluids but exclude sand. If the sand screens fail, unconsolidated reservoir sand will enter the wellbore and necessitate shutting in the well for cleaning-out and remediation with cement plugs. This operation is very difficult and dangerous since the wellbore can contain explosive levels of oil and oxygen.

In order to quantify the effect of fluid injection into the horizontal wellbore, a number of computer numerical simulations of the process were conducted. Steam was injected at a variety of rates into the horizontal well by two methods: 1. via tubing placed inside the horizontal well, and 2. via a separate well extending near the base of the reservoir in the vicinity of the toe of the horizontal well. Both of these methods reduced the prediliction of oxygen to enter the wellbore but gave surprising and counterintuitive benefits: the oil recovery factor increased and build-up of coke in the wellbore decreased. Consequently, higher oxidizing gas injection rates could be used while maintaining safe operation.

It was found that both methods of adding steam to the reservoir provided advantages regarding the safety of the THAI™ Process by reducing the tendency of oxygen to enter the horizontal wellbore. It also enabled higher oxidizing gas injection rates into the reservoir, and higher oil recovery.

Extensive computer simulation of the THAI™ Process was undertaken to evaluate the consequences of reducing the pressure in the horizontal wellbore by injecting steam or non-oxidizing gas. The software was the STARS™ In Situ Combustion Simulator provided by the Computer Modelling Group, Calgary, Alberta, Canada.

Table 4. List of Model Parameters.

Simulator: STARS™ 2003 13, Computer Modelling Group Limited

Model Dimensions:

Length 250 m, 100 grid blocks, eac
Width 25 m, 20 grid blocks
Height 20 m, 20 grid blocks
Grid Block dimensions: 2.5 m×2.5 m×1.0 m (LWH).

Horizontal Production Well:

A discrete well with a 135 m horizontal section extending from grid block 26, 1, 3 to 80, 1, 3 The toe is offset by 15 m from the vertical air injector.

Vertical Injection Well:

Oxidizing gas(air) injection points: 20, 1, 1:4 (upper 4-grid blocks)

Oxidizing gas Injection rates: 65,000 m3/d, 85,000 m3/d or 100,000 m3/d

Steam injection points: 20, 1, 19:20 (lower 2-grid blocks)

Rock/Fluid Parameters:

Components: water, bitumen, upgrade, methane, CO2, CO/N2, oxygen, coke
Heterogeneity: Homogeneous sand.
Permeability: 6.7 D (h), 3.4 D (v)
Porosity: 33%
Saturations: Bitumen 80%, water 20%, gas Mole fraction 0.114
Bitumen viscosity: 340,000 cP at 10° C.
Bitumen average molecular weight: 550 AMU
Upgrade viscosity: 664 cP at 10° C.
Upgrade average molecular weight: 330 AMU Physical Conditions:

Reservoir temperature: 20° C.
Native reservoir pressure: 2600 kPa.
Bottomhole pressure: 4000 kPa.

Reactions:

1. 1.0 Bitumen---->0.42 Upgrade+1.3375 CH4+20 Coke
2. 1.0 Bitumen+16 O2^0.05---->12.5 water+5.0 CH4+9.5 CO2+0.5 CO/N2+15 Coke
3. 1.0 Coke+1.225O2---->0.5 water+0.95 CO2+0.05 CO/N2

EXAMPLES

Example 1

Table 1a shows the simulation results for an air injection rate of 65,000 m3/day (standard temperature and pressure) into a vertical injector (E in FIG. 1). The case of zero steam injected at the base of the reservoir at point I in well J is not part of the present invention. At 65,000 m3/day air rate, there is no oxygen entry into the horizontal wellbore even with no steam injection and the maximum wellbore temperature never exceeds the target of 425° C.

However, as may be seen from the data below, injection of low levels of steam at levels of 5 and 10 m3/day (water equivalent) at a point low in the reservoir (E in FIG. 1) provides substantial benefits in higher oil recovery factors, contrary to intuitive expectations. Where the injected medium is steam, the data below provides the volume of the water equivalent of such steam, as it is difficult to otherwise determine the volume of steam supplied as such depends on the pressure at the formation to which the steam is subjected to. Of course, when water is injected into the formation and subsequently becomes steam during its travel to the formation, the amount of steam generated is simply the water equivalent given below, which typically is in the order of about 1000× (depending on the pressure) of the volume of the water supplied.

TABLE 1a

AIR RATE 65,000 $m^3$/day-Steam injected at reservoir base.

| Steam Injection Rate $m^3$/day (water equivalent) | Maximum well Temperature, ° C. | Maximum coke in wellbore % | Maximum Oxygen in wellbore % | Bitumen recovery Factor % OOIP | Average oil Production Rate m3/day |
|---|---|---|---|---|---|
| *0 | 410 | 90 | 0 | 35.1 | 28.3 |
| 5 | 407 | 79 | 0 | 38.0 | 29.0 |
| 10 | 380 | 76 | 0 | 43 1 | 29.8 |

*Not part of the present invention.

Example 2

Table 1b shows the results of injecting steam into the horizontal well via the internal tubing, G, in the vicinity of the toe while simultaneously injecting air at 65,000 m3/day (standard temperature and pressure) into the upper part of the reservoir. The maximum wellbore temperature is reduced in relative proportion to the amount of steam injected and the oil recovery factor is increased relative to the base case of zero steam. Additionally, the maximum volume percent of coke deposited in the wellbore decreases with increasing amounts of injected steam. This is beneficial since pressure drop in the wellbore will be lower and fluids will flow more easily for the same pressure drop in comparison to wells without steam injection at the toe of the horizontal well.

TABLE 1b

AIR RATE 65,000 $m^3$/day-Steam injected in well tubing.

| Steam Injection Rate m3/day (water equivalent) | Maximum well Temperature, ° C. | Maximum coke in wellbore % | Maximum Oxygen in wellbore % | Bitumen recovery Factor % OOIP | Average oil Production Rate m3/day |
|---|---|---|---|---|---|
| *0 | 410 | 90 | 0 | 35.1 | 28.6 |
| 5 | 366 | 80 | 0 | 43.4 | 30.0 |
| 10 | 360 | 45 | 0 | 43.4 | 29.8 |

*Not part of the present invention.

Example 3

In this example, the air injection rate was increased to 85,000 m3/day (standard temperature and pressure) and resulted in oxygen breakthrough as shown in Table 2a. An 8.8% oxygen concentration was indicated in the wellbore for the base case of zero steam injection. Maximum wellbore temperature reached 1074° C. and coke was deposited decreasing wellbore permeability by 97%. Operating with the simultaneous injection of 12 m3/day (water equivalent) of steam at the base of the reservoir via vertical injection well C (see FIG. 1) provided an excellent result of zero oxygen breakthrough, acceptable coke and good oil recovery TABLE 2a AIR RATE 85,000 $m^3$/day-Steam injected at reservoir base.

| Steam Injection Rate m3/day (water equivalent) | Maximum well Temperature, ° C. | Maximum coke in wellbore % | Maximum Oxygen in wellbore % | Bitumen recovery Factor % OOIP | Average oil Production Rate m3/day |
|---|---|---|---|---|---|
| *0 | 1074 | 97 | 8.8 | | |
| 5 | 518 | 80 | 0 | | |
| 12 | 414 | 43 | 0 | 36.1 | 33.4 |

*Not part of the present invention.

Example 4

Table 2b shows the combustion performance with 85,000 m3/day air (standard temperature and pressure) and simultaneous injection of steam into the wellbore via an internal tubing G (see FIG. 1). Again 10 m3/day (water equivalent) of steam was needed to prevent oxygen breakthrough and an acceptable maximum wellbore temperature.

TABLE 2b

AIR RATE 85,000 $m^3$/d. Steam injected in well tubing.

| Steam Injection Rate m3/day (water equivalent) | Maximum well Temperature, ° C. | Maximum coke in wellbore % | Maximum Oxygen in wellbore % | Bitumen recovery Factor % OOIP | Average oil Production Rate m3/day |
|---|---|---|---|---|---|
| *0 | 1074 | 100 | 8.8 | | |
| 5 | 500 | 96 | 1.8 | | |
| 10 | 407 | 45 | 0 | 37.3 | 33.2 |

*Not part of the present invention.

Example 5

In order to further test the effects of high air injection rates, several runs were conducted with 100,000 m3/day air injection. Results in Table 3a indicate that with simultaneous steam injection at the base of the reservoir (ie at location B-E in vertical well C-ref. FIG. 1), 20 m3/day (water equivalent) of steam was required to stop oxygen breakthrough into the horizontal leg, in contrast to only 10 m3/day steam (water equivalent) at an air injection rate of 85,000 m3/day.

TABLE 3a

AIR RATE 100,000 $m^3$/day-Steam injected at reservoir base.

| Steam Injection Rate m3/day (water equivalent) | Maximum well Temperature, ° C. | Maximum coke in wellbore % | Maximum Oxygen in wellbore % | Bitumen recovery Factor % OOIP | Average oil Production Rate m3/day |
|---|---|---|---|---|---|
| *0 | 1398 | 100 | 10.4 | | |
| 5 | 1151 | 100 | 7.2 | | |
| 10 | 1071 | 100 | 6.0 | | |
| 20 | 425 | 78 | 0 | 34.5 | 35.6 |

*Not part of the present invention.

Example 6

Table 3b shows the consequence of injecting steam into the well tubing G (ref. FIG. 1) while injecting 100,000 m3/day air into the reservoir. Identically with steam injection at the reservoir base, a steam rate of 20 m3/day (water equivalent) was required in order to prevent oxygen entry into the horizontal leg.

TABLE 3b

AIR RATE 100,000 $m^3$/d. Steam injected in well tubing.

| Steam Injection Rate m3/day (water equivalent) | Maximum well Temperature, ° C. | Maximum coke in wellbore % | Maximum Oxygen in wellbore % | Bitumen recovery Factor % OOIP | Average oil Production Rate m3/day |
|---|---|---|---|---|---|
| *0 | 1398 | 100 | 10.4 | | |
| 5 | 997 | 100 | 6.0 | | |
| 10 | 745 | 100 | 3.8 | | |
| 20 | 425 | 38 | 0 | 33.9 | 35.6 |

*Not part of the present invention.

Example 7

Table 4 below shows comparisons between injecting oxygen and a combination of non-oxidizing gases, namely nitrogen and carbon dioxide, into a single vertical injection well in combination with a horizontal production well in the THAI™ process via which the oil is produced, as obtained by the STARS™ In Situ Combustion Simulator software provided by the Computer Modelling Group, Calgary, Alberta, Canada. The computer model used for this example was identical to that employed for the above six examples, with the exception that the modeled reservoir was 100 meters wide and 500 meters long. Steam was added at a rate of 10 m3/day via the tubing in the horizontal section of the production well for all runs, heel of the horizontal well). Moreover, with carbon dioxide injected in the vertical well, and/or in the horizontal production well, production rates improved production rates can be expected.

Although the disclosure described and illustrates preferred embodiments of the invention, it is to be understood that the invention is not limited to these particular embodiments. Many variations and modifications will now occur to those skilled in the art. For definition of the invention, reference is to be made to the appended claims.

| Test | Injection Rate, $km^3$/day | | | Mol % Oxygen | Mol % CO2 | Total Injection Rate, | Production Rate, km3/day | | Produced Gas Mol % | Oil Rate m3/day | Cumulative Oil Recovery |
|---|---|---|---|---|---|---|---|---|---|---|---|
| # | O2 | CO2 | N2 | Injected | Injected | $km^3$/day | CO2 | N2 | CO2 | (1-year) | m3 |
| 1 | 17.85 | 0 | 67.15 | 21 | 0 | 85 | 13.1 | 67.2 | 16.3 | 41 | 9700 |
| 2 | 8.93 | 33.57 | 0 | 21 | 79 | 42.5 | 37.9 | 0.0 | 96.0 | 54 | 12780 |
| 3 | 25 | 0 | 0 | 100 | 0 | 25 | 21.3 | 0.0 | 96.0 | 47 | 10078 |
| 4 | 17.85 | 67.15 | 0 | 21 | 79 | 85 | 75.0 | 0.0 | 96.0 | 136 | 20000 |
| 5 | 42.5 | 0 | 0 | 100 | 0 | 42.5 | 38.1 | 0.0 | 96.0 | 57 | 12704 |
| 6 | 42.5 | 42.5 | 0 | 50 | 50 | 85 | 74.2 | 0.0 | 96.0 | 113 | 28104 |
| 7 | 8.93 | 42.5 | 33.57 | 11 | 50 | 85 | 47.2 | 33.6 | 57.4 | 70 | 12000 |

As may be seen from above Table 4 comparing Run 1 and Run 2, when the oxygen and inert gas are reduced by 50% as in Run2, the oil recovery is nevertheless the same as in Run 1, providing that the inert gas is CO2. This means that the gas compression costs are cut in half in Run 2, while oil is produced faster.

As may further be seen from above Table 4, Run #1 having 17.85 molar % of oxygen and 67.15% nitrogen injected into the injection well, estimated oil recovery rate was 41 m3/day. In comparison, using a similar 17.85 molar % oxygen injection with 67.15 molar % carbon dioxide as used in Run #4, a 3.3 times increase in oil production (136 m3/day) is estimated as being achieved.

As may be further seen from Table 4 above, when equal amounts of oxygen and CO2 are injected as in Run 6, still with a total injected volume of 85,000 m3/day, oil recovery was increased 2.7-fold.

Run 7 shows the benefit of adding CO2 to air as the injectant gas Compared with Run 1, oil recovery was increased 1.7-fold without increasing compression costs. The benefit of this option is that oxygen separation equipment is not needed.

Referring now to FIG. 3, which is a graph showing a plot of oil production rate versus CO2 rate in the produced gas (drawing on Example 7 above), there is a strong correlation between these parameters for in situ combustion processes. CO2 production rate depends upon two CO2 sources: the injected CO2 and the CO2 produced in the reservoir from coke combustion, so there is a strong synergy between CO2 flooding and in situ combustion even in reservoirs with immobile oils, which is the present case.

SUMMARY

For a fixed amount of steam injection, the average daily oil recovery rate increased with air injection rate. This is not unexpected since the volume of the sweeping fluid is increased. However, it is surprising that the total oil recovered decreases as air rate is increased. This is during the life of the air injection period (time for the combustion front to reach the The embodiments of the invention in which an exclusive property or privilege is claimed are defined as follows:

1. A process for extracting liquid hydrocarbons from an underground reservoir, comprising the steps of:

(a) providing at least one injection well for injecting an oxidizing gas into an upper part of an underground reservoir;

(b) said at least one injection well further adapted for injecting steam, a non-oxidizing gas, or water which is subsequently heated to steam, into a lower part of an underground reservoir;

(c) providing at least one production well having a substantially horizontal leg and a substantially vertical production well connected thereto, wherein the substantially horizontal leg extends toward the injection well, the horizontal leg having a heel portion in the vicinity of its connection to the vertical production well and a toe portion at the opposite end of the horizontal leg, wherein the toe portion is closer to the injection well than the heel portion;

(d) injecting an oxidizing gas through the injection well for in situ combustion, so that combustion gases are produced, wherein the combustion gases progressively advance laterally as a front, substantially perpendicular to the horizontal leg, in the direction from the toe portion to the heel portion of the horizontal leg, and fluids drain into the horizontal leg;

(e) injecting a medium, wherein said medium is selected from the group of mediums comprising steam, water or a non-oxidizing gas, into said injection well; and (f) recovering hydrocarbons in the horizontal leg of the production well from said production well.

2. The process of claim 1 wherein said medium is water, and said water is subsequently heated to become steam and said steam is provided to said lower part of the formation via a distal end of said injection well.

3. A process for extracting liquid hydrocarbons from an underground reservoir, comprising the steps of:

(a) providing at least one oxidizing gas injection well for injecting an oxidizing gas into an upper part of an underground reservoir;

(b) providing at least one other injection well for injecting steam, a non-oxidizing gas, or water which is subsequently heated to steam, into a lower part of an underground reservoir;

(c) providing at least one production well having a substantially horizontal leg and a substantially vertical production well connected thereto, wherein the substantially horizontal leg extends toward the oxidizing gas injection well, the horizontal leg having a heel portion in the vicinity of its connection to the vertical production well and a toe portion at the opposite end of the horizontal leg, wherein the toe portion is closer to the oxidizing gas injection well than the heel portion;

(d) injecting an oxidizing gas through the oxidizing gas injection well for in situ combustion, so that combustion gases are produced, wherein the combustion gases progressively advance laterally as a front, substantially perpendicular to the horizontal leg, in the direction from the toe portion to the heel portion of the horizontal leg, and fluids drain into the horizontal leg;

(e) injecting a medium, wherein said medium is selected from the group of mediums comprising steam, water or a non-oxidizing gas, into said other injection well; and (f) recovering hydrocarbons in the horizontal leg of the production well from said production well.

4. The process of claim 3 wherein said medium is water, and said water is subsequently heated to become steam and said steam is provided to said lower part of the formation via a distal end of said other injection well.

5. A method for extracting liquid hydrocarbons from an underground reservoir, comprising the steps of:

(a) providing at least one injection well for injecting an oxidizing gas into an upper part of an underground reservoir;

(b) said at least one injection well further adapted for injecting carbon dioxide into a lower part of an underground reservoir;

(c) providing at least one production well having a substantially horizontal leg and a substantially vertical production well connected thereto, wherein the substantially horizontal leg extends toward the injection well, the horizontal leg having a heel portion in the vicinity of its connection to the vertical production well and a toe portion at the opposite end of the horizontal leg, wherein the toe portion is closer to the injection well than the heel portion;

(d) injecting an oxidizing gas through the injection well for in situ combustion, so that combustion gases are produced wherein the combustion gases progressively advance laterally as a front, substantially perpendicular to the horizontal leg, in the direction from the toe portion to the heel portion of the horizontal leg, and fluids drain into the horizontal leg;

(e) injecting carbon dioxide alone or in combination with oxygen into said injection well; and (f) recovering hydrocarbons from said production well.

6. A method for extracting liquid hydrocarbons from an underground reservoir, comprising the steps of:

(a) providing at least one oxidizing gas injection well for injecting an oxidizing gas into an upper part of an underground reservoir; p1 (b) providing at least one other injection well for injecting carbon dioxide into a lower part of an underground reservoir;

(c) providing at least one production well having a substantially horizontal leg and a substantially vertical production well connected thereto, wherein the substantially horizontal leg extends toward the oxidizing gas injection well, the horizontal leg having a heel portion in the vicinity of its connection to the vertical production well and a toe portion at the opposite end of the horizontal leg, wherein the toe portion is closer to the oxidizing gas injection well than the heel portion;

(d) injecting an oxidizing gas through the oxidizing injection well for in situ combustion, so that combustion gases are produced wherein the combustion gases progressively advance laterally as a front, substantially perpendicular to the horizontal leg in the direction from the toe portion to the heel portion of the horizontal leg, and fluids drain into the horizontal leg;

(e) injecting carbon dioxide alone or in combination with oxygen into said other injection well; and (f) recovering hydrocarbons from said production well.

* * * * *

UNITED STATES PATENT AND TRADEMARK OFFICE

CERTIFICATE OF CORRECTION

PATENT NO. : 7,493,953 B2
APPLICATION NO. : 12/076024
DATED : February 24, 2009
INVENTOR(S) : Conrad Ayasse It is certified that error appears in the above-identified patent and that said Letters Patent is hereby corrected as shown below:

On the title page, item [73]: The assignee Archon Technologies Lcd. should be Archon Technologies Ltd., see copy of assignment recordation sheet attached.

Signed and Sealed this

Seventh Day of April, 2009

JOHN DOLL
*Acting Director of the United States Patent and Trademark Office*